US005530511A

United States Patent [19]

Verlinden et al.

[11] Patent Number: 5,530,511

[45] Date of Patent: Jun. 25, 1996

[54] PHOTOGRAPHIC LIQUID PROCESSING STATION

[75] Inventors: Bartholomeus Verlinden, Tongeren; Patrick Van den Bergen, Berchem, both of Belgium

[73] Assignee: Agfa-Gevaert N.V., Mortsel, Belgium

[21] Appl. No.: 316,242

[22] Filed: Sep. 30, 1994

[30] Foreign Application Priority Data

Oct. 15, 1993 [EP] European Pat. Off. ..... 93202901

[51] Int. Cl.[6] ..... G03D 3/02; G03D 13/00

[52] U.S. Cl. ..... 354/298; 354/322; 354/324

[58] Field of Search ..... 354/324, 325, 354/298, 323, 322, 320, 321; 430/398–400, 30

[56] References Cited

U.S. PATENT DOCUMENTS

| | | | |
|---|---|---|---|
| 3,822,723 | 7/1974 | Crowell et al. | 137/625.15 |
| 3,858,229 | 12/1974 | Stievenart et al. | 354/331 |
| 4,045,839 | 9/1977 | Parsonage | 15/302 |
| 4,451,132 | 5/1984 | Kishimoto | 354/324 |
| 5,019,850 | 5/1991 | Ishikawa et al. | 354/322 |
| 5,040,013 | 8/1991 | Kurokawa et al. | 354/322 |
| 5,177,522 | 1/1993 | Hayashi | 354/320 |
| 5,302,995 | 4/1994 | Hayashi | 354/323 |
| 5,466,563 | 11/1995 | Ishikawa et al. | 354/322 X |

FOREIGN PATENT DOCUMENTS

| | | |
|---|---|---|
| 0531234 | 3/1993 | European Pat. Off. . |
| 3246897 | 6/1983 | Germany . |

*Primary Examiner*—D. Rutledge

*Attorney, Agent, or Firm*—Brumbaugh, Graves, Donohue & Raymond

[57] ABSTRACT

A photographic liquid processing station (14) comprising at least two sections (15, 16) through which a photographic sheet material is passed in succession, the processing liquid being fed through said sections in countercurrent, replenishing means (67) which comprises discharge means (70) for carrying off rinsing liquid from the first section (15) in response to the amount of processed film, pump means (63) for feeding liquid from the second section (16) to the first one (15) in response to a level sensor (61) in the first section, and a liquid level sensor (64) in the last section (16) for controlling said replenishing means (67).

6 Claims, 4 Drawing Sheets

PHOTOGRAPHIC LIQUID PROCESSING STATION

DESCRIPTION

1. Field of the Invention

The present invention relates to a photographic liquid processing station, more in particular to a washing/rinsing station with several processing sections, the liquid flow through the different sections being in a countercurrent to the direction of transport of a sheet material through the station.

2. Description of the Prior Art

It is known in the art to perform the rinsing of a silver halide photographic material which has been developed and fixed, by means of a rinsing station which comprises two or more rinsing tanks through which the material is passed in succession, the rinsing liquid flowing in countercurrent. The advantage is that the last rinsing tank will contain almost fresh rinsing water so that silver effluent will be small.

Circulation of rinsing water in countercurrent is obtained through overflow weirs separating the successive rinsing tanks. Replenishing liquid is added to the last tank. A rinsing station of the described kind is disclosed e.g. in EP 0 422 664 A2 of E. I. Du Pont de Nemours and Cy, USA and in DE 41 05 916 A1 of Agfa-Gevaert AG, DE. A disadvantage of liquid level control by means of a weir is the limited precision of the level.

If, for one reason or another, the liquid level of the last tank is below that of its weir and a sensor asks for replenishing liquid, it may take some time before the last tank is filled up to its weir. Next starts the formation of a liquid meniscus on the weir. The size of the meniscus may have to amount to 2–3 mm before liquid effectively starts to overflow the weir. In the meantime, the liquid level in the foregoing tanks may have dropped further as a consequence of its carrying off by the processed material. The described phenomenon is not detrimental to the rinsing as such of the material. However, there are constructional features that may require a liquid level without too much fluctuations. For instance, if the upper roller of each transport roller pair for the sheet material only partly dips in the processing liquid, and the shafts of these upper rollers extend through cut out portions of the lateral walls of the tanks for entering in driving engagement with a drive gear, too high a level of the rinsing liquid in the tank can cause leakage through such cut outs, whereas too low a level will cause the upper rollers to run dry.

The present invention has been developed in particular for the washing and rinsing of multicolour proofs which are prepared preparatory to printing. Colour proofs are required for inspection and approval by the printer or his client before printing on the production press commences.

According to a common colour proofing process, a non-hardened gelatin silver halide emulsion layer containing coloured pigment particles dispersed therein is transferred from a temporary onto a permanent support which may already carry a halftone image containing coloured hardened gelatin, the transferred silver halide emulsion layer is imagewise exposed to a colour separation negative of the original, a halftone image is formed by hardening development, the formed silver image is removed by bleach-fixing, the selectively unhardened portions of the transferred layer are selectively removed by wash-off processing, and all these steps are repeated to form a composite layer structure containing usually a cyan, a yellow, a magenta and a black-and-white part image. The term wash-off processing implies treating the material with water to remove the unhardened portions thereof, resulting in the accumulation of gelatin and pigments in the rinsing water, but also rinsing the washed material in order to eliminate the very last unhardened components that otherwise may cause an undesirable hue in the final image.

Treating the described material in countercurrent is thus an ideal situation since the last tank will contain pure water whereas the most unclear water will be found in the first tank.

SUMMARY OF THE INVENTION

Object of the Invention

It is an object of the present invention to provide an improved photographic liquid processing station with at least two processing sections through which processing liquid is fed in countercurrent, which has an improved liquid level control.

The present invention has been particularly developed in connection with colour proofing as described hereinbefore. However, it is not limited to washing, resp. rinsing, but may be used in other stations as well, for instance in a fixing station. We refer to our co-pending application EP 0 598 145 entitled "A method of processing imagewise exposed photographic silver halide material in countercurrent" which deals with fixing in countercurrent.

Statement of Invention

In accordance with the present invention, a photographic liquid processing station comprising at least two sections through which a photographic sheet material is passed in succession, the processing liquid being fed through said sections in countercurrent, and replenishing means for adding processing liquid to the last section, is characterised thereby that it comprises:

- discharge means for carrying off rinsing liquid from the first section in response to the amount of processed sheet material,
- pump means for feeding liquid from the second section to the first one, in response to a level sensor in the first section, and pump means for feeding liquid from each next to each other preceding section in case there are more than two sections, and
- a liquid level sensor in the last section for controlling said replenishing means.

It is clear that the mechanism of liquid replacement in the processing station is different from that known in the art, since according to the invention a controlled amount of liquid is withdrawn from the first section and automatically replaced by fresh liquid in the last section whereas according to the art a controlled amount of fresh liquid is added to the last section which then flows via weirs to the first section.

The term "replenishing" stands in the present specification for the operation of replacing a certain amount of used processing liquid by fresh liquid in order to obtain the desired processing conditions, and/or adding fresh liquid in order to compensate for liquid removal by a processed sheet.

The term "section" stands for tray-like recipients through which the photographic material is passed along a slightly concavely curved path by some roller pairs but it encompasses deeper recipients through which the material is passed by a plurality of roller pairs as well.

The term "discharge means" stands for a remote-controlled valve for removing a desired quantum of liquid by gravity from the first section by gravity, but it also encompasses a volumetric pump, such as a peristaltic or a bellows-type pump, for removing, occasionally against gravity, a desired amount of liquid.

The term "sheet material" stands for shorter and longer lengths, including strips and webs, of photographic material having a film or paper base.

BRIEF DESCRIPTION OF THE DRAWINGS

The invention will be described hereinafter by way of example with reference to the accompanying drawings wherein.

DETAILED DESCRIPTION OF THE INVENTION

Figure 1:
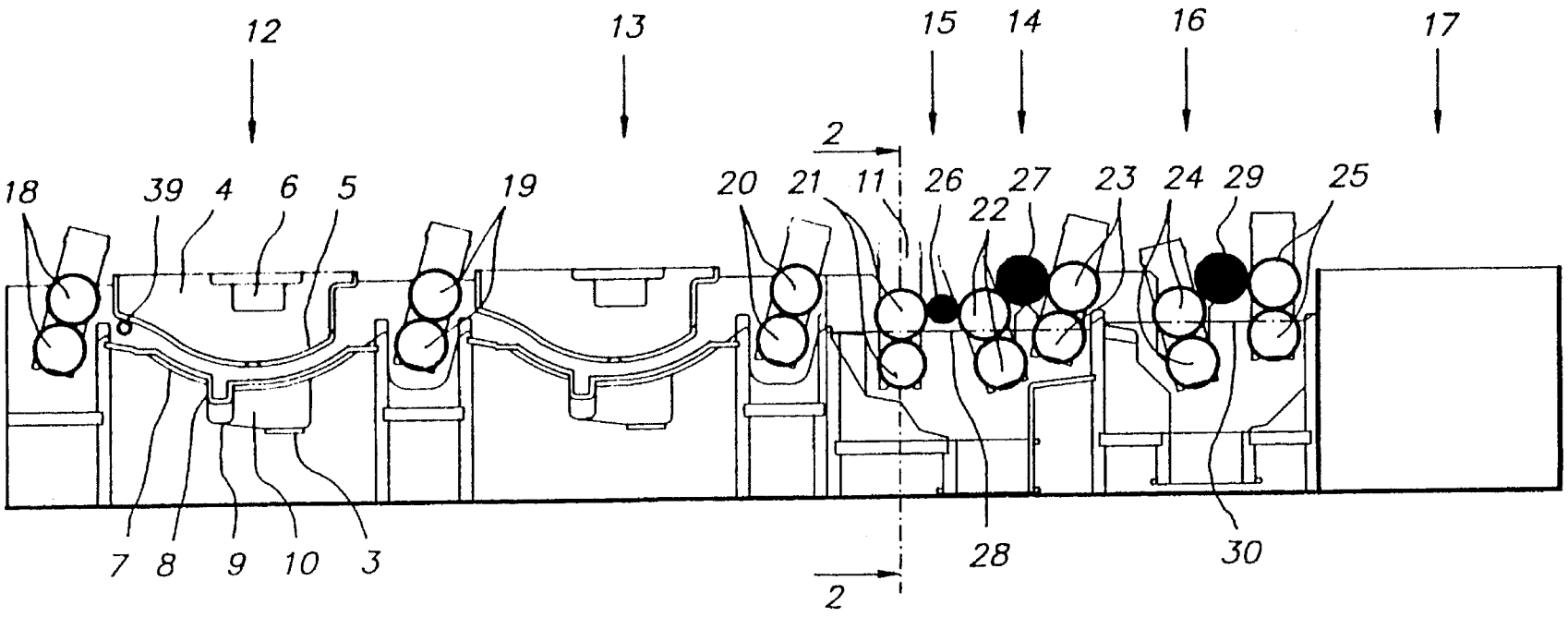
FIG. 1 is a diagrammatic longitudinal section of one embodiment of a processor for colour proof material.

Referring to FIG. 1, there is shown diagrammatically a processor for the processing of an exposed photographic film for colour proofing, which comprises a developing station 12, a bleach-fixing station 13, a rinsing station 14 with a first section 15 and a second one 16, and a drying station 17.

A sheet of film is transported at uniform velocity through the processor by means of suitably driven pressure roller pairs 18, 19, 20, 21, 22, 23, 24 and 25, the roller pairs for the dryer being not shown. Each roller pair is mounted between two lateral walls spaced in parallel relationship, see one wall 11 shown for roller pair 21, that slide in a corresponding slot-like recess at the inside of the corresponding lateral wall of the processing station and are easily removable for cleaning and servicing.

Sensor means 39 which may be of the mechanical, optical or capacitive type, serves to measure the amount of sheet material which is being processed. The term "amount" should be interpreted in the broadest possible sense. It covers a simple sensor which measures the length only of a processed sheet (by multiplication of measured time by speed of transport) and thereby gives indications which are independent from the width of the sheet and, as well as a row of sensors that extend widthwise of the processor and give an indication of the length as well as of the width of the sheets.

A particularly interesting embodiment of sensing means is disclosed in our copending applications EP 0 582 751 and EP 0 583 032, both entitled "Photographic development apparatus, filed Aug. 11, 1992.

Developing station 12 comprises a tray 7 with a central gutter 8 slightly running down in a direction transverse to that of the sheet transport, and having a deepest point 9 communicating with a holder 10 from which liquid can be withdrawn at point 11. A cover 4 has a convexly curved bottom 5 defining with the shape of tray 7 a concave path for the sheet transport. A grip 6 allows easy removal of the cover from the tray.

The developing station may be connected to a cubitainer containing appropriate developer composition which is circulated continuously through the station. A cubitainer is a commonly used liquid container in the form of a collapsible plastic bag in a rectangular cardboard box. Since the amount of developer liquid contained in the tray-like station 12 is small as compared with that in the cubitainer, oxidation at the air is limited.

Fixing station 12 has a construction which is identic to that of the developing station and may be connected to a cubitainer containing a bleach-fixing solution. In this instance it is advantageous to carry out the replenishing of the station as a function of the amount of processed material. Liquid overflowing the processing tray after replenishing liquid has been added is received in a buffer tank.

Rinsing station 14 comprises a first section 15 which is operative as a washing station, and a second station 16 which operates as a rinsing station. It is clear that the processing operations in both stations are in fact identical, but the large amount of soluble material from a processed film which is collected in the first section appeals on washing rather than on rinsing.

Section 15 comprises three pressure roller pairs 21, 22 and 23 driven as will be explained hereinafter, and intermediate cleaning rollers 26 and 27 driven by frictional contact with the upper rollers of the different roller pairs. The cleaning rollers have a circumferential covering of a resilient velvet-like material that is very effective in keeping the upper rollers of roller pairs 21 to 23 clean. More details about these cleaning rollers are set forth in our co-pending application entitled "Photographic processing station with cleaning rollers" filed on Oct. 11, 1993. Both rollers of the roller pairs 21 to 23 comprise a resilient covering, e.g. a layer of butyl rubber. The level of the rinsing water in this section is indicated by broken line 28.

The construction of the second section 16 is largely similar to that of the first one, except that only two pressure roller pairs 24 and 25 are provided with one co-operating cleaning roller 29. The roller pairs have a resilient covering, similar to roller pairs 21, 22 and 23. The liquid level in this section is indicated by line 30.

Figure 2:
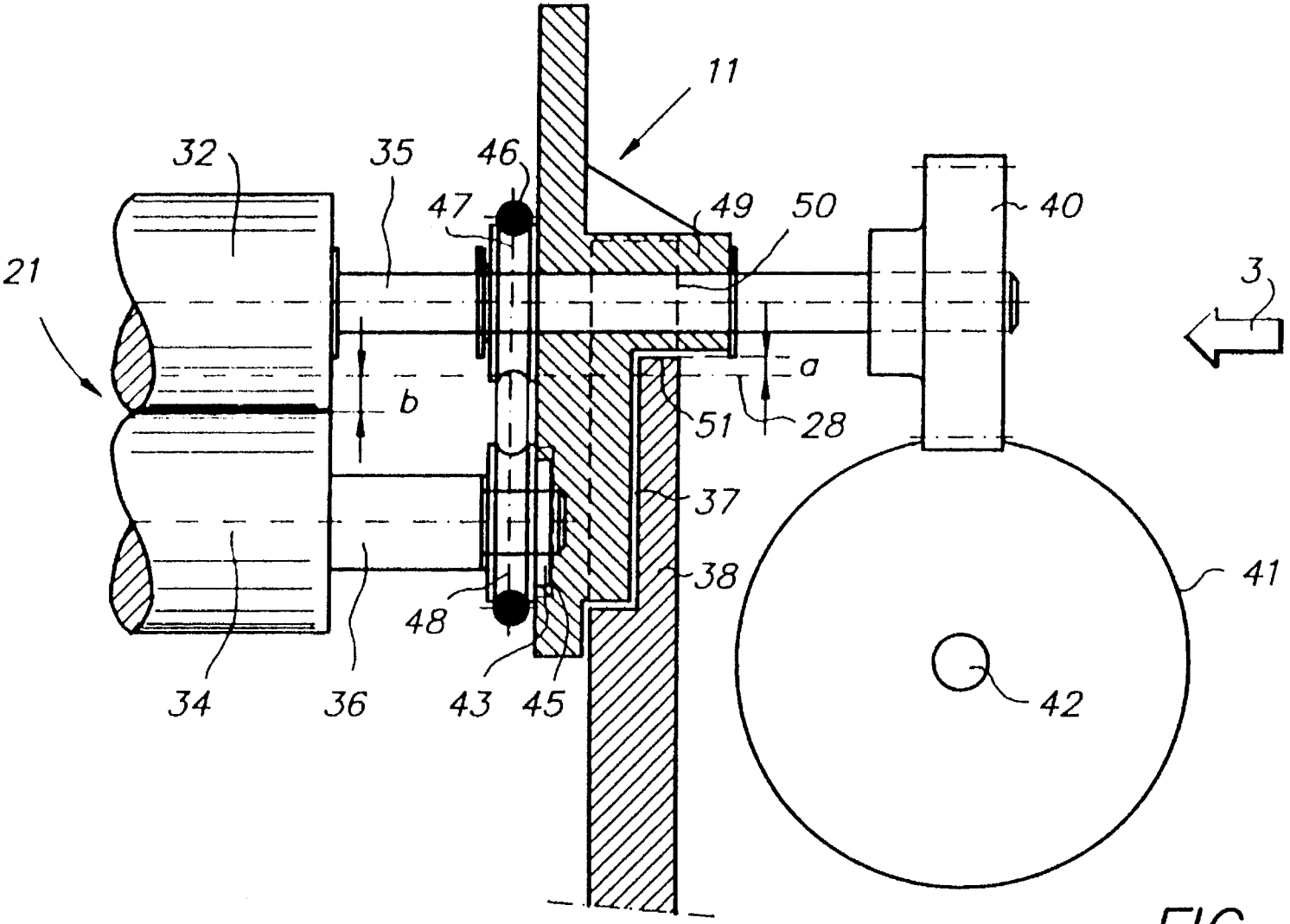
FIG. 2 is a partial diagrammatic transverse section of the rinsing station of the processor on line 2—2 of FIG. 1.

FIG. 2 shows a partial diagrammatic transverse section of rinsing section 15 on line 2—2 through the axes of roller pair 21.

Roller pair 21 comprises rollers 32 and 34 with shafts 35 and 36 that are journalled at both ends in bearing elements, one element being shown as bearing 11 slideably fitting in a corresponding vertical slotlike recess 37 at the inside of lateral wall 38 of the processing tray of the section. Shaft 35 extends through the bearing element and has at its extremity a worm gear 40 cooperating with a worm 41 on a drive shaft 42 that extends horizontally along the different stations. The other extremity of shaft 35 is rotatably journalled inside of the corresponding lateral wall of the processing tray. Shaft 36 is rotatably journalled in a bearing 43 that is vertically displaceable over a limited distance in a corresponding groove 45 shown in broken lines at the inside face of bearing element 11. Roller 34 is biased towards roller 32 by means of a coiled spring 46 that is tensioned in the form of an endless belt about two pulley-like ring members 47 and 48, member 47 making part of bearing block 11, and member 48 making part of bearing 43. A similar construction is provided at the opposite end of the roller pair.

Figure 3:
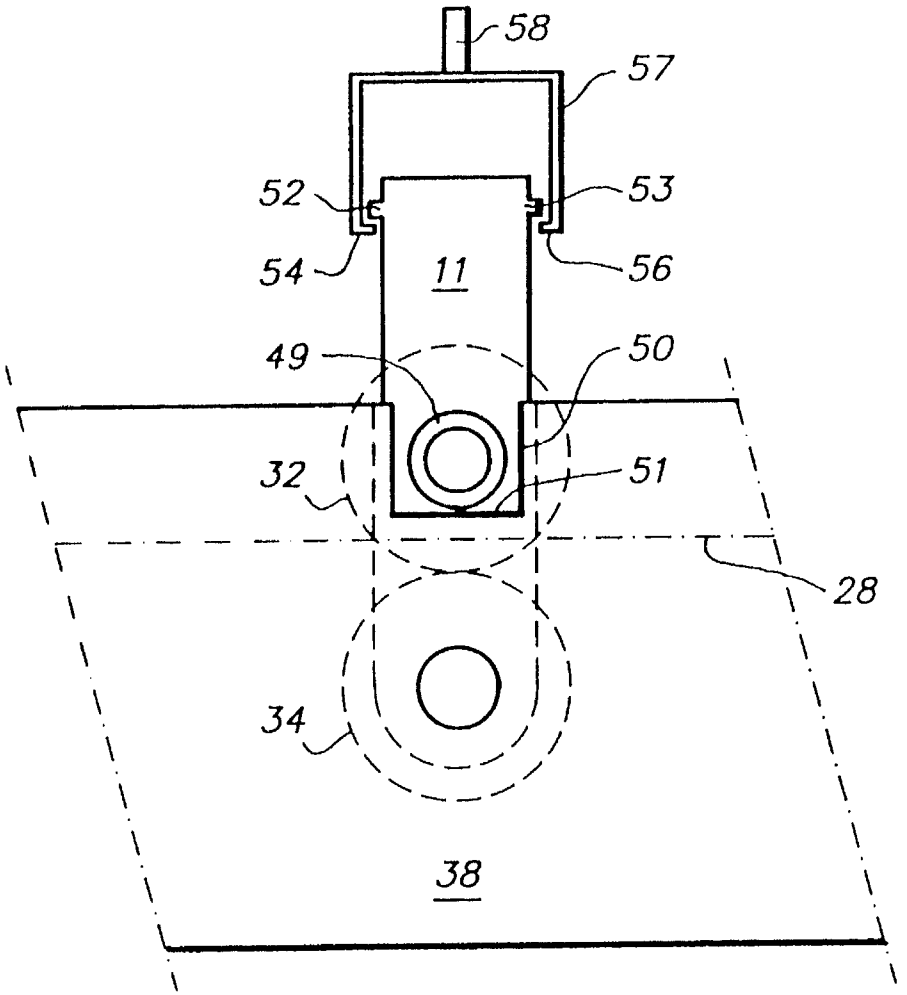
FIG. 3 is a view according to arrow 3 of FIG. 2, the roller drive being deleted.

Bearing element 11 has a cylindrical bearing section 49 extending through a corresponding recess 50 in lateral wall 38 of the tray, see also FIG. 3. The bottom edge of this recess is indicated by numeral 51, and it should be understood that the level 28 of the liquid in the tray has to remain well below this edge in order to avoid leakage of liquid. All the bearing elements 11 of the processor have near their upper end two opposed lugs 52 and 53 as shown in FIG. 3, which can be engaged by incurred edges 54, 56 of a beam 57 having an inverted U shape. The beam is slid by the operator in the transverse direction of the processor over the two bearing elements of a given roller pair. A handle 58 on top of the beam allows one to easily lift the engaged roller pair from the processor.

The mounting and driving of all the other roller pairs are equal to roller pair 21 described hereinbefore. The roller pairs of the processor are located at different heights. Therefore, their worm gears and corresponding worms have different diameters to enable their driving by one common drive shaft 42.

The liquid level 28 in section 15 is well below the deepest point 51 of lateral wall 38 but above the lowest point of the circumference of upper roller 32 so that this roller is kept wet. The difference between the liquid level 28 and the overflow edge 51 is indicated by a, whereas the difference between liquid level 28 and the level at which roller 32 starts running dry is indicated by b. It is clear that roller 32 is kept moistened in any way by contact with roller 34 dipping in the liquid, but this moistening of roller 32 ceases as a sheet enters the nip of both rollers.

Drier 17 is conventional in the art and can have the form of a flat bed drier comprising a plurality of blower slots located at either side of the film path.

Figure 4:
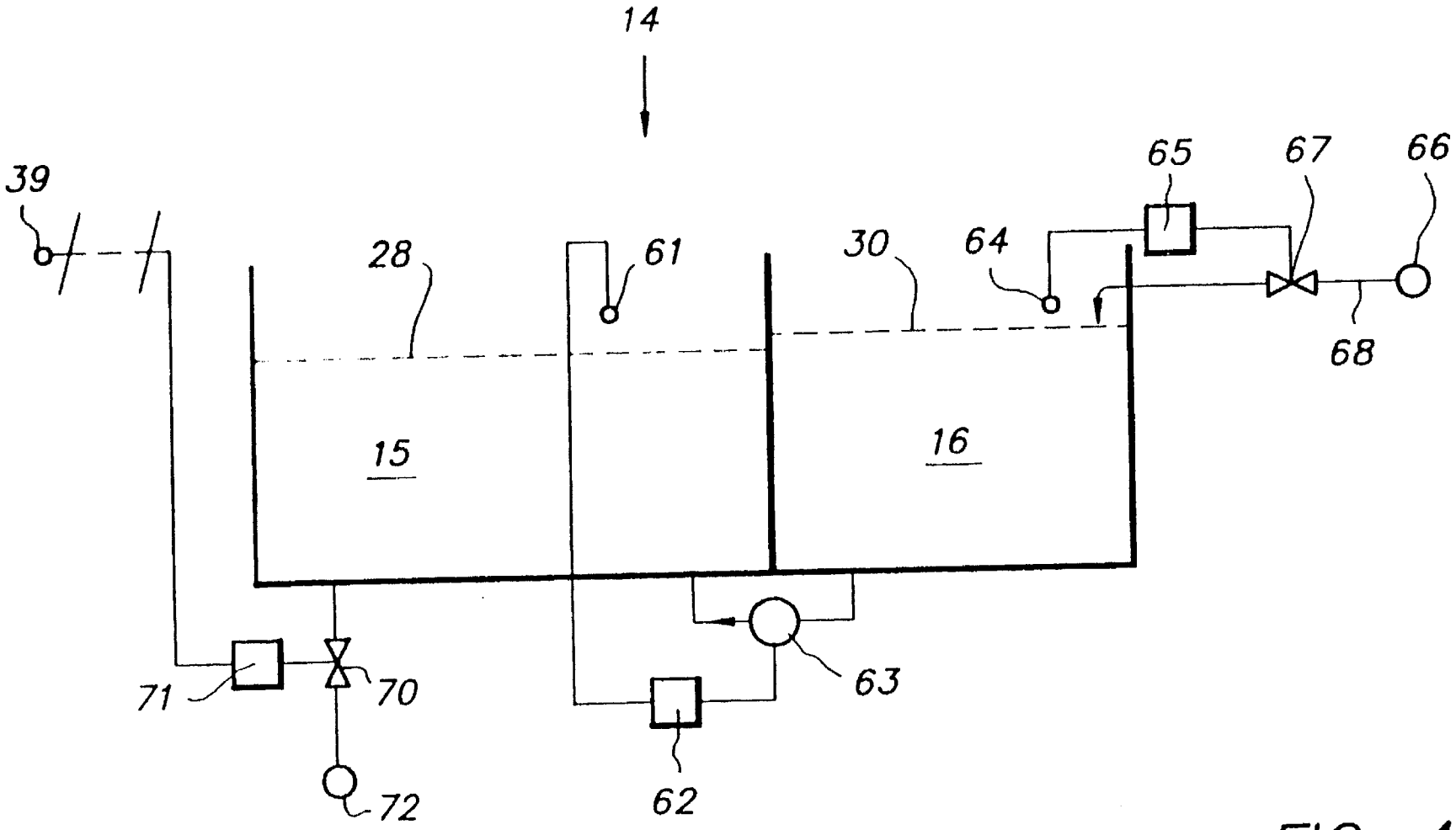
FIG. 4 is a diagrammatic view of the liquid control of the rinsing station of the processor of FIG. 1.

FIG. 4 shows the replenishing control of the rinsing station. The level 28 of rinsing liquid in section 15 is controlled by a suitable sensor 61. This sensor is coupled with a controller 62 for a volumetric pump 63. If the liquid level becomes too low, pump 63 is operated to feed liquid from section 16 to section 15 until the required level 28 is obtained. The liquid level in section 16 being destroyed by such pumping, a sensor 64 which is responsive to such level actuates via controller 65 a valve 67 in a rinsing liquid conduit 68 from a supply 66 to restore level 30. The supply 66 of liquid may be a tank with liquid or a tap water connection.

If replenishing of rinsing liquid is required under control of film sensor 39, valve 70 is opened by controller 71 during a pre-set period during which a given amount of rinsing liquid is carried off from section 15. This removal of liquid automatically entails replenishing of sections 15 and 16 as described hereinbefore. Liquid carried off via valve 70 contains gelatin, pigments and other components from the unhardened image portions of the processed sheets and may flow to a buffer tank 72 or directly to the sewer. Its removal from the rinsing station causes its replacement by fresh rinsing liquid so that soiling of the rinsing station remains within acceptable limits, ensuring satisfactory washing and rinsing of further sheets.

In operation of the processor, an image-wise exposed film sheet carrying a coloured pigment layer which has been image-wise exposed is first developed and next bleach fixed. As the film sheet enters the rinsing station, frictional contact with the first roller pair 21 removes at least 50% of the non-hardened pigment layer. Removed particles adhering to the bottom roller are quickly removed by the rinsing liquid since the roller completely dips into the liquid. Particles adhering to the top roller are removed by contact with cleaning roller 26. Yet these particles do not remain on said roller since upon continued rotation these particles are transferred from roller 26 to the upper roller of roller pairs 21 and 22, and next to the corresponding bottom roller from which they are rapidly washed away by the rinsing water.

EXAMPLE

The following example gives the characteristics of the rinsing station of the processor described hereinbefore.

| | |
|---|---|
| Operational length of roller pairs | |
| 21, 22, 23, 24 and 25 | mm |
| Diameter of these rollers | mm |
| Diameter of rollers 26 | mm |
| 27 | mm |
| 29 | mm |
| Operational width of the station | mm |
| Bearing elements 11, made from . . . | |
| Liquid contents of section 15 | $dm^3$ |
| Fluctuations of level 28 | mm |
| Liquid contents of section 16 | $dm^3$ |
| Fluctuations of level 30 | mm |
| Pump 63 | bellows-type pump |
| (juist ?) | |
| Rate of pump 63 | $ml.min^{-1}$ |
| Rate of valve 70 | $ml.min^{-1}$ |
| a | mm |
| b | mm |
| Replenishing rate | ml for . . . $dm^{-2}$ of processed sheet |

The invention is not limited to the embodiment of the invention described hereinbefore.

The rinsing station may comprise circulation pumps for producing a circulation of rinsing liquid in the different section.

The station may comprise more than two rinsing sections. The rinsing liquid may be pure water but also water containing certain additives depending on the type of material being processed.

The liquid discharge means 70 may also be in the form of a volumetric pump. This may be interesting if the rinsing liquid tends to form a deposit on the walls of the carrying off conduit or of the valve so that gravity does not ensure a constant rate of the long run.

Member 72 may be a buffer tank as mentioned already. In a particularly interesting embodiment of the invention, liquid may be withdrawn from such tank and fed, after appropriate filtering to point 66 so that it is available as replenishing liquid for the last section of the station. In this way an autonomously operating rinsing station is obtained which operates independent from a tap water connection.

Depending on the type of processed material, it may be required to improve the rinsing and/or cleaning capacity of the rinsing station. An imposed rinsing (respectively washing) effect is obtained by the use of more roller pairs than those shown. An improved cleaning effect may be obtained by replacing one or more of the lower rollers of the roller pairs by a cleaning roller of the type of rollers 26, 27 and 29. Good results have been obtained in this respect by replacing the lower roller of entry roller pair 21 by a roller of the type of rollers 27 and 29.

The construction of the sheet driving rollers may be different from the illustrated. For instance, each section of the rinsing station may comprise a conventional roller rack, with a plurality of roller pairs mounted between two walls kept in parallel spaced relationship by interconnecting rods. All the different rollers are interconnected by appropriate gears, an extra top gear being provided the shaft of which extends laterally over the station and enters in driving engagement with a common drive shaft. A disadvantage of suchlike construction is the large weight, as compared with that of the distinct roller pair elements of the apparatus described hereinbefore. In the described apparatus, the weight of the distinct roller pairs has been kept to an absolute minimum by omitting any additional gears and shafts that would be required for driving the rollers in the usual way, and by performing the drive in a direct way by passing one shaft of each roller pair through a cut-out in a lateral wall of the processing section.

The liquid levels 28 and 30 have been illustrated as differing from each other, but it is clear that one liquid level may exist in the different sections of a station.

We claim:

1. A photographic liquid processing station (14) comprising:

a plurality of sections in sequence, comprising a first section (15) and a last section (16) and such that each one of the sections save the first section has a preceding section, through which sections a photographic sheet material is passed in succession, and processing liquid being fed through said sections in countercurrent, replenishing means for adding additional processing liquid to the last section, discharge means (70) for carrying off an amount of processing liquid from the first section (15) in response to an amount of processed sheet material, pump means (63) for feeding processing liquid to each respective preceding section (15) from each section (16) having a preceding section (15), in response to a level sensor (61) in the respective preceding section, and a further level sensor (64) in the last section (16) for controlling said replenishing means.

2. The photographic liquid processing station according to claim 1, wherein said discharge means (70) is formed by a valve.

3. The photographic liquid processing station according to claim 1, wherein said discharge means (70) is formed by a volumetric pump.

4. The photographic liquid processing station according to claim 1, wherein said replenishing means is formed by a valve (67) controlling a conduit (68) with pressurised processing liquid.

5. The photographic processing station according to claim 1, wherein said level sensors (61, 64) determine the same liquid levels in the sections.

6. The photographic processing station according to claim 1, wherein said processing station is a rinsing station.

* * * * *